US009375734B1

(12) United States Patent
van der Steur et al.

(10) Patent No.: US 9,375,734 B1
(45) Date of Patent: Jun. 28, 2016

(54) COATING APPARATUS TURBINE HAVING INTERNALLY ROUTED SHAPING AIR

(71) Applicants: Gunnar van der Steur, Chasapeake City, MD (US); Joseph P Cichocki, Newark, DE (US); Lance W Fleming, Jr., Perryville, MD (US)

(72) Inventors: Gunnar van der Steur, Chasapeake City, MD (US); Joseph P Cichocki, Newark, DE (US); Lance W Fleming, Jr., Perryville, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 0 days.

(21) Appl. No.: 14/740,363

(22) Filed: Jun. 16, 2015

(51) Int. Cl.

| | |
|---|---|
| ***B05B 5/04*** | (2006.01) |
| ***B05B 3/04*** | (2006.01) |
| ***B05B 7/14*** | (2006.01) |
| ***B05B 7/08*** | (2006.01) |
| ***B05B 15/04*** | (2006.01) |

(52) U.S. Cl.
CPC ..... *B05B 3/0418* (2013.01); *B05B 7/08* (2013.01); *B05B 7/1486* (2013.01); *B05B 15/0431* (2013.01)

(58) Field of Classification Search
CPC .. B05B 5/0407; B05B 7/0815; B05B 5/0415; B05B 5/04; B05B 3/1064
USPC ..... 239/703
See application file for complete search history.

(56) References Cited

U.S. PATENT DOCUMENTS

| | | | | | |
|---|---|---|---|---|---|
| 4,114,564 | A * | 9/1978 | Probst | B05B 3/1042 | 118/626 |
| 4,337,895 | A | 7/1982 | Gallen | | |
| 4,589,597 | A * | 5/1986 | Robisch | B05B 3/1064 | 239/224 |
| 4,721,630 | A * | 1/1988 | Takeo | B05B 13/0292 | 118/314 |
| 4,788,933 | A * | 12/1988 | Buschor | B05B 5/032 | 118/629 |
| 4,896,834 | A * | 1/1990 | Coeling | B05B 5/0415 | 239/296 |
| 4,997,130 | A | 3/1991 | Weinstein | | |
| 5,011,086 | A * | 4/1991 | Sonnleitner | B05B 5/0533 | 239/691 |
| 5,039,019 | A * | 8/1991 | Weinstein | B05B 5/0533 | 239/691 |
| 5,106,025 | A * | 4/1992 | Giroux | B05B 15/0258 | 239/112 |
| 5,397,063 | A | 3/1995 | Weinstein | | |
| 5,662,278 | A * | 9/1997 | Howe | B05B 3/1064 | 239/690 |

(Continued)

*Primary Examiner* — Arthur O Hall
*Assistant Examiner* — Chee-Chong Lee
(74) *Attorney, Agent, or Firm* — E. Alan Uebler, PA

(57) ABSTRACT

In rotary coating apparatus for coating a substrate, the apparatus includes a rotatable bell cup coating applicator affixed to the distal end of a rotatable drive shaft driven by a turbine, and including a source of supply of suitable coating material, a source of pressurized air for driving the turbine, a second source of pressurized air for creating and directing a curtain of air circumferentially and externally about the bell cup to shape and control the diameter and pattern of the coating material applied to the substrate. More specifically, the apparatus includes multiple air channels formed therein and through the apparatus through which the drive air and the shaping air are conveyed to and through the turbine to (1) drive the turbine and (2) to control the shape and pattern of the applied coating.

16 Claims, 5 Drawing Sheets

(56) References Cited

U.S. PATENT DOCUMENTS

| | | | | |
|---|---|---|---|---|
| 5,697,559 | A | 12/1997 | Davis | |
| 5,788,164 | A | 8/1998 | Tomita | |
| 5,803,372 | A * | 9/1998 | Weinstein | B05B 3/1064 239/223 |
| 5,853,126 | A * | 12/1998 | Alexander | B05B 3/1064 239/223 |
| 5,922,131 | A * | 7/1999 | Haas | B05B 3/1064 118/620 |
| 6,050,499 | A | 4/2000 | Takayama | |
| 6,672,521 | B2 * | 1/2004 | Reichler | B05B 5/0418 239/700 |
| 7,036,750 | B2 | 5/2006 | Krumma | |
| 7,131,601 | B2 | 11/2006 | Nolte | |
| 7,611,069 | B2 | 11/2009 | Clifford | |
| 7,762,481 | B2 | 7/2010 | Clifford | |
| 2004/0129799 | A1 | 7/2004 | Krumma | |
| 2005/0129872 | A1 * | 6/2005 | van der Steur | B05B 15/025 427/458 |
| 2006/0169937 | A1 * | 8/2006 | Nolte | B05B 1/306 251/129.04 |
| 2006/0208102 | A1 * | 9/2006 | Nolte | B05B 3/1014 239/224 |
| 2007/0034715 | A1 | 2/2007 | Clifford | |
| 2007/0063068 | A1 | 3/2007 | Seitz | |

* cited by examiner

COATING APPARATUS TURBINE HAVING INTERNALLY ROUTED SHAPING AIR

FIELD OF THE INVENTION

The invention relates to rotary bell cup coating apparatus used in the application of coatings to substrates and, more particularly, to paint and/or powder coatings applied to workpieces such as vehicles using such apparatus. Specifically, the invention provides an improved turbine and auxiliary apparatus having unique and improved routing through the turbine of both the turbine driving air and the shaping air which governs the diameter and pattern of the applied coating.

BACKGROUND OF THE INVENTION

Rotary coating apparatus having a bell cup applicator for applying coatings to workpieces is known in the art, and known to be driven by compressed air actuated turbines. Such bell cup applicators are used in operations wherein liquid based paint is atomized at the outer edge of the spinning cup and sprayed onto the workpiece, as well as in similar operations wherein powder coatings are applied directly to the substrate.

Electrical charges are often applied to the coating particles to enhance adherence to the grounded workpiece. Cups can rotate from 10,000 to upwards of 70,000 rpm and, owing to such high speeds, the cups must be mounted on their drive shafts with extreme precision in order to minimize radial load imbalances in operation.

Coating operations are typically carried out robotically. In operation at high speeds, the coating material, for various reasons, can back up into unintended areas of the rotary drive mechanisms and onto the workpiece being coated, possibly causing imperfections in the coating and/or downtime in the coating operation, all of which are undesirable events. To counter and minimize such events, auxiliary apparatus is generally provided whereby a solvent cleaning fluid can periodically be caused to pass through and over the bell cup and various parts of the coating apparatus in order to clean them.

It is also known in prior art coaters to provide a cylindrically shaped curtain of air, termed "shaping air", about the spinning bell cup during the coating process, which directs the coating particles toward the workpiece and controls the diameter and pattern of the sprayed particles. To provide this curtain of shaping air, it is known to include a plurality of shaping air orifices through the shroud over the turbine which are concentric with the bell cup, adjacent the outside surface thereof. Shaping air is routed to and into the shroud between the shroud and the turbine and, in some instances, through openings in the bearing or bearing retainer supporting the turbine, and/or through spaces between the turbine housing and the bearing retainer, and back into the turbine housing before passing to and outwardly through the shaping air orifices, thereby forming a generally cylindrical curtain about the rotating cup.

The foregoing briefly and generally describes the state of the art and the basic principles relating to the invention described and claimed herein, and these will not be repeated below. For specific prior art references describing such apparatus, reference may be had to U.S. Pat. Nos. 5,397,063; 7,036,750B2 and 7,131,601 B2.

SUMMARY OF THE INVENTION

In rotary coating apparatus for coating a substrate, a rotatable bell cup coating applicator affixed to the distal end of a rotatable drive shaft driven by a turbine within a turbine housing is provided. The turbine and turbine housing through which the drive shaft extends are all contained within an external shroud. The apparatus includes a source of supply of coating material, a source of pressurized air for driving the turbine, a second source of pressurized air for creating and directing a curtain of air circumferentially and externally about the bell cup to shape and control the diameter and pattern of applied coating material. More specifically, the apparatus includes multiple air passageways formed within and through the turbine housing to convey the shaping air from the second source of air to and through the turbine housing.

The shaping air passageways include an inlet channel leading into the turbine housing to initially convey the shaping air from the source thereof to a manifold channel at the proximal end of the turbine housing extending coaxially and circumferentially within the turbine housing about the axis of rotation of the turbine. The proximal manifold channel has fluidly connected thereto a plurality of generally axially oriented shaping air conduits spaced apart circumferentially about the axis of rotation of the turbine and extending axially and substantially through the turbine housing. The proximal ends of the axially oriented shaping air conduits all open into and are interconnected by the proximal manifold channel. The distal ends of the axially oriented shaping air conduits are all interconnected by and open into a second manifold channel proximate the distal end of the turbine housing, the distal manifold channel extending coaxially and circumferentially within the turbine housing about the axis of rotation of the turbine. The second, distal manifold channel has a plurality of outlets therefrom and therearound opening into and connected to a corresponding plurality of exit air conduits extending through the external shroud from the plurality of second manifold outlets, respectively, to exit openings therefrom to the atmosphere, which openings are arranged circumferentially around the shroud adjacent the outside surface of the bell cup, to and through which openings the shaping air is conveyed.

Upon introduction of shaping air into the apparatus, the shaping air is conveyed into and through the passageways within the apparatus and exits through the exit openings which encircle the periphery of the bell cup adjacent thereto, thereby forming the shape-controlling curtain of air therearound.

The coating apparatus may advantageously include at least two external conduits for conveying pressurized turbine driving air from a source thereof to the turbine. The two external conduits are connected, respectively, to inlet ports in a connector plate affixed to the base of the turbine. The connector plate has two channels therethrough, one channel extending from each inlet port and thence converging with the second channel and opening into a single drive air outlet, the single connector plate drive air outlet mating at the base of the turbine with a single drive air inlet into an intermediate air flow distribution drive plate of the turbine. The intermediate plate houses the blades of the turbine and has a circumferential channel formed therein and therearound extending from the single drive air inlet, partially and substantially around the intermediate plate, through which channel the drive air is directed into a plurality of nozzles and thence to the turbine blades, thereby driving the turbine.

The apparatus is useful in applications in which the coating material is paint and the bell cup applicator is a rotary bell cup atomizer, or alternatively, the coating material is a powder coating material and the bell cup applicator is a rotary bell cup powder applicator.

The axially oriented shaping air conduits can extend through the turbine parallel to the axis of rotation of the turbine or, if advantageous, the axially oriented shaping air conduits can extend through the turbine angled to the axis of rotation of the turbine. The apparatus preferably includes 6-18 axially oriented shaping air conduits, and 12 conduits are most preferred.

The apparatus preferably includes 8-30 exit air conduits, and 24 exit air conduits are most preferred.

The above-mentioned intermediate flow distribution drive plate preferably also includes a valved inlet to a separate air braking channel having a nozzle formed therein disposed to channel drive air on command against the turbine blades in a direction opposite to the drive air direction of flow during coating, to thereby provide a braking action to the turbine blades.

A process of coating a substrate using the apparatus of the invention is also provided.

BRIEF DESCRIPTION OF THE DRAWINGS

In the accompanying drawings.

DETAILED DESCRIPTION OF THE INVENTION AND PREFERRED EMBODIMENTS WITH REFERENCE TO THE DRAWINGS

In rotary coating apparatus for coating a substrate, the apparatus includes a rotatable bell cup coating applicator affixed to the distal end of a rotatable drive shaft driven by a turbine, and including a source of supply of suitable coating material, a source of pressurized air for driving the turbine, a second source of pressurized air for creating and directing a curtain of air circumferentially and externally about the bell cup to shape and control the diameter and pattern of the coating material applied to the substrate. More specifically, the apparatus includes multiple air channels formed therein and through which the drive air and the shaping air are conveyed to and through the turbine to (1) drive the turbine and (2) to control the shape and pattern of the applied coating.

Figure 1:
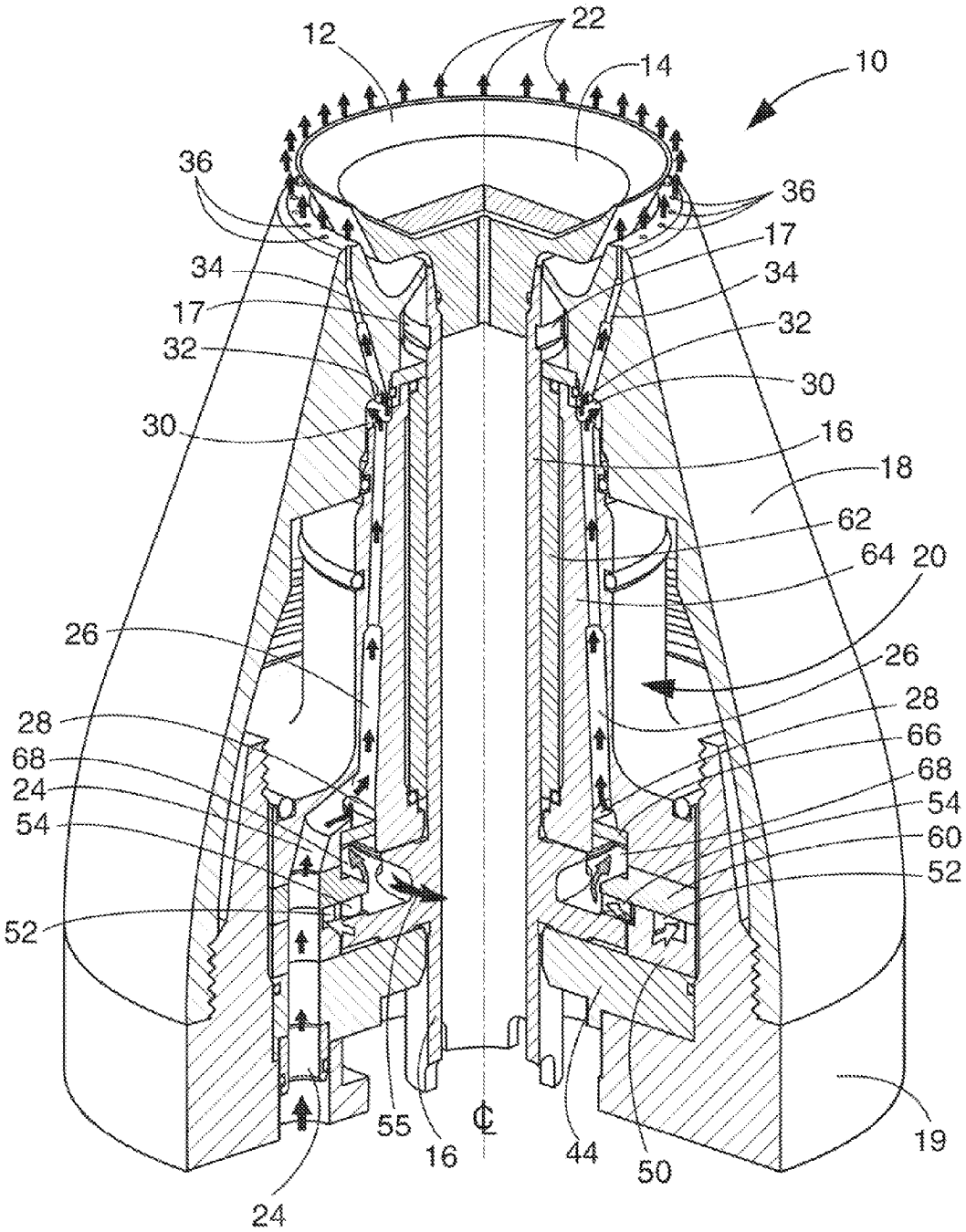
FIG. 1 is a perspective view, partially in cross-section, of an embodiment of the invention.

A detailed description of the invention is best provided with reference to the accompanying drawings wherein FIG. 1 depicts, in a perspective view, partially in cross-section, one embodiment 10 of the invention. Therein, a rotary bell cup coating applicator 12 having flow deflector 14 and driven within air bearing 62 by rotational drive shaft 16 powered by turbine 20 is depicted, all contained within a front shroud 18 and a rear housing component 19. It will become apparent in what follows that the main focus of the invention is on providing apparatus for and delivery of compressed air to the coating apparatus to (a) drive the turbine 20 which actuates the coater 10 and (b) to produce an effective curtain of shaping air surrounding the applied coating as it is sprayed upon a workpiece (not shown) from the bell cup 12. Accordingly, and consistently in all figures, the flow of driving air to and through the apparatus is represented by hollow arrows, and the flow of shaping air is represented by solid arrows. The flow of driving air which is spent and exhausted from the system is depicted by shaded arrows. Where the air stream depiction indicates air applied to cause rotation of the turbine during coating, a solid arrow having a "tail" is employed. Not shown in the drawings, but to be understood as needed in the coating process, are the external sources of coating materials, air sources, electrical connections, solvent cleaning sources, details of the external shroud, the gasketing, the sealing, and attaching via bolting and the like, materials of construction, and specific coating materials being applied, all of which will be apparent to one skilled in this field or are omitted simply for clarity in presentation.

In accord with this representation scheme, shaping air is shown entering the coating apparatus of FIG. 1 through shaping air inlet channel 24 which channel 24 extends from its inlet through connector plate 44. The shaping air then passes through intermediate air distribution plate 50, which is donut-shaped and, in addition, channels drive air and houses the rotating turbine blades as described below. The shaping air then passes through openings 24 in spacer plate 60 and sealing plate 66, as shown and enters into a plurality of generally axially oriented shaping air conduits 26 positioned concentrically and circumferentially about the centerline of the apparatus, all formed within the housing 64 of the turbine 20.

For purposes of clarity of presentation, reference to the turbine 20 generally will encompass drive shaft 16 driving the turbine blades 54, and the plate components 50, 60, 66 and their auxiliary features and elements, and the turbine housing 64, all to be described in more detail with reference to FIG. 3.

Referring back to FIG. 1, the shaping air inlet channel 24 transitions into a plurality of axially oriented shaping air conduits 26 which have their proximal ends located, as shown, near the base of turbine housing 64. These proximal ends of axially oriented shaping air conduits 26 are all interconnected thereat to one another by coaxial circumferential proximal manifold channel 28, which effectively equalizes the pressure within the shaping air system. From the juncture of inlet channel 24 and proximal circumferential manifold channel 28, the axially oriented shaping air conduits 26 extend from the manifold channel 28 at the proximal ends of conduits 26 through the turbine housing 64 to the distal ends of conduits 26 where they are all interconnected thereat to distal, coaxial and circumferential second manifold channel 30 extending around turbine 20 at its distal end within the turbine housing 64. The distal manifold channel 30 has a plurality of outlets 32 therefrom positioned therearound which open into a corresponding plurality of exit air conduits 34 extending through shroud 18 to a corresponding number of shaping air exit openings 36 in the shroud 18 positioned, as shown, adjacent peripherally around the outside surface of the bell cup 12, thereby directing the exiting shaping air to form a cylindrical air curtain as depicted by the solid arrows circumferentially around the rotating bell cup 12. From the inlet 24 of shaping air into the apparatus of the invention to the formation of the shaping air curtain, the shaping air is delivered through and within the housing 64 of the turbine and never passes outwardly therefrom from the turbine into or through the air bearing assembly 62 in which the turbine rotates. This distinguishing feature of the invention will become apparent when compared with certain prior art devices described below in connection with FIG. 2.

In the described apparatus of the invention, the axially oriented shaping air conduits 26 may extend parallel to the centerline of the apparatus or, advantageously, angled to the centerline to provide improved flow. The number of axially oriented shaping air conduits preferably ranges from 6-18 and 12 such conduits are most preferred.

The number of exit air conduits 34 spaced axially about the apparatus and having exit openings 36 from shroud 18 positioned adjacent the outside surface of the bell cup 12 preferably ranges from 8-30, and 12 such conduits are most preferred.

Figure 2A:
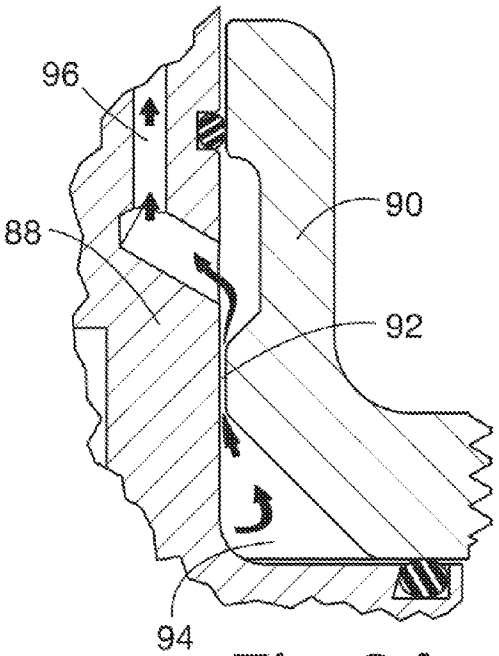
Fig. 2A. PRIOR ART
FIG. 2A is an enlarged view taken along line 2A-2A of FIG. 2.
Figure 2:
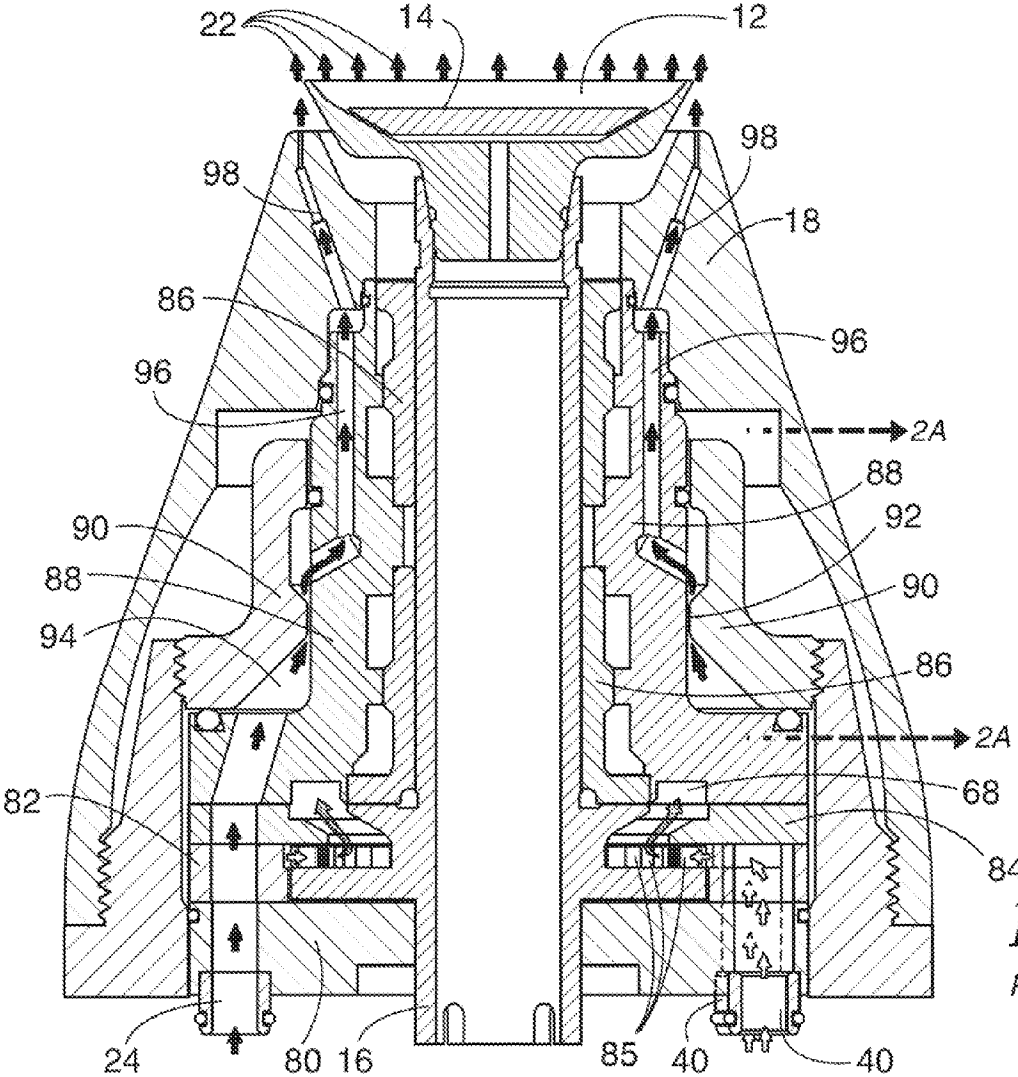
Fig. 2. PRIOR ART
FIG. 2 is a cross-sectional view of a coating apparatus known in the prior art.

For comparison purposes, a prior art device for delivering driving air and shaping air to rotational bell cup coating apparatus is depicted in FIG. 2.

FIG. 2 depicts one embodiment of prior art coating apparatus in which a coating is applied with a rotary bell cup applicator 12 driven by an air-actuated turbine and having a curtain of shaping air 22 directed to and around the outside surface of the rotating cup 12 to control the shape and pattern of the coating being applied to the workpiece. In FIG. 2, common elements of the apparatus with elements described above will be referred to by common numbers, and additional general descriptions of these common elements will not be repeated.

Referring to FIG. 2, drive air to the apparatus, depicted by open arrows, enters two inlets 40 from an external source thereof and is channeled to the turbine blades 85 housed within drive plate 82 which drives the blades 85 actuating the coating apparatus. A specific rotary atomizer for atomizing paint for coating applications driven by a turbine having multiple air-driven blades disposed in a housing is described in the above-mentioned '601 patent. Therein is described a turbine with a plurality of turbine blades extending from a rotatable turbine wheel. The apparatus includes an intermediate annular chamber in the housing fluidly connected to a plurality of nozzles which are defined within the chamber for delivering a fluid, air, into the chamber, for driving onto the turbine blades to actuate the apparatus. According to the "Summary" of the invention disclosed in the '601 patent, a first inlet is defined in the intermediate annular chamber for delivering fluid into the annular chamber and at least one second inlet is defined in the annular chamber for also delivering fluid into the annular chamber, thereby increasing the amount of fluid in the annular chamber, which is said to increase rotational speed of the rotatable turbine wheel as the increased amount of fluid is introduced to the turbine blades through a plurality of nozzles. An advantage of the '601 claimed apparatus is said to be in providing several inlets defined in the intermediate annular chamber instead of one individual enlarged inlet.

In contrast to this prior patent, as discussed in detail below, drive air to the turbine according to the invention herein is delivered to the turbine through a single individual, enlarged inlet.

With reference again to FIG. 2, shaping air is known to be supplied to coating apparatus from an external source to form an air curtain 22 about a rotating applicator 14, routed through the apparatus as depicted therein, namely passing from a source into and through channel 24 formed within a base plate 80 of the turbine assembly, thence through a drive plate 82 (e.g., see the '601 patent) of the turbine, and through a spacer plate 84 and into the turbine housing 88, from there exiting into air space 94 between the retainer ring 90 and the turbine housing 88. As shown, the air then passes through the annular gap 92 between the retainer ring 90 and the housing 88, this gap 92 extending circumferentially around the turbine housing 88. From gap 92, the shaping air enters a plurality of shaping air conduits 96 and thence into and through a corresponding plurality of exit air conduits 98 before exiting outwardly therefrom to form the air curtain 22, all as shown in FIG. 2.

FIG. 2A, an enlarged, partial cross-sectional view taken along line 2A-2A of FIG. 2, shows in greater detail the gap 92 through which the shaping air passes between the turbine housing 88 and the retainer ring 92, on its path to and through one of the shaping air conduits 96.

Figure 3:
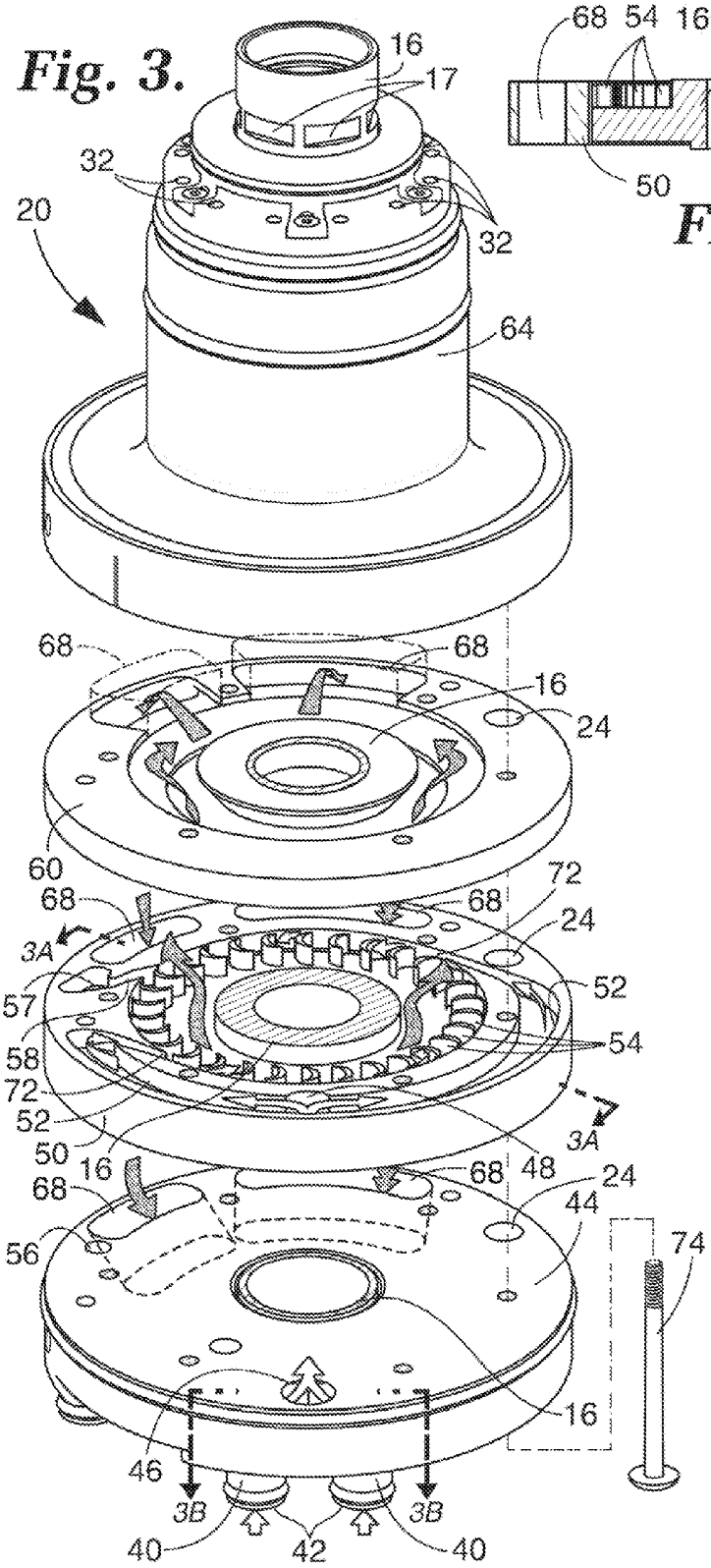
FIG. 3 is an exploded perspective view of elements of the invention.

In contrast, FIG. 3 depicts a preferred embodiment according to the invention. Therein, in an exploded, perspective view, details of the separate main components of the turbine assembly are illustrated, specifically the drive air inlet ports 42 leading into connector plate 44, the donut-shaped intermediate plate 50 into which the drive air enters through the single, individual inlet 48 and is directed into channel 52 and distributed bi-directionally therearound and directed through nozzles 72 onto turbine blades 54, which blades are housed and rotate within the "donut hole" of plate 50 which, as shown, is covered by spacer plate 60 through which spent drive air exhausts as shown by the arrows, covered and sealed by sealing plate 66, not shown here but shown in FIGS. 1 and 6, all bolted to the housing 64 of the turbine assembly 20. The assembly 20 is held together by bolts 74, six in total, one representation thereof being shown. The rotating turbine blades 54 are affixed to drive shaft 16 which extends through and rotates within the assembly to actuate it, all as shown.

Figure 3A:
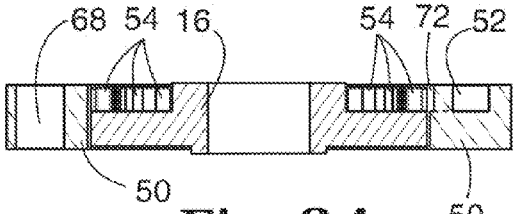
FIG. 3A is a partial cross-section taken along line 3A-3A of FIG. 3.
Figure 3B:
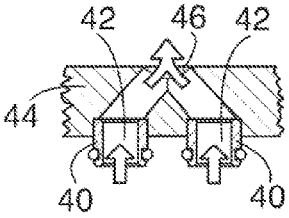
FIG. 3B is a partial cross-section taken along line 3B-3B of FIG. 3.

The most straightforward way to describe the details of the turbine assembly segments is to follow the path of the driving air ("in" air indicated by open arrows; exhaust air by shaded arrows) as it passes through the system. Accordingly, drive air enters the two inlet ports 40 and is channeled through respective channels 42 which converge within plate 44 as shown in FIG. 3B, to exit plate 44 at the outlet 46 therefrom.

Intermediate plate 50, which sits atop plate 44, receives the drive air from the outlet 46 of plate 44 through plate 50 inlet 48, from which the air is directed into channel 52 in both directions outwardly from outlet 48 and circumferentially around plate 50, into and through the two nozzles 72, from which the air is directed to and impinges upon turbine blades 54 to drive the system. Also formed within plate 50 is braking air channel 58 extending from inlet 57 in plate 50 which is supplied from valved breaking air outlet 56 just below in plate 44.

Plate 50 also houses, in its center opening, the rotating turbine blades 54 affixed to drive shaft 16. FIG. 3A, taken along line 3A-3A, of FIG. 3, in cross-section, illustrates the relative positioning of the turbine blades 54 housed within plate 50, and including circumferential air distribution channel 52 and air nozzles 72.

Spacer plate 60 attaches to and covers intermediate plate 50, and has exhaust air channels 68 therein as shown to allow spent drive air to dissipate, these exhaust channels 68 extending, as shown, through all plates 60, 50 and 44.

Figure 6:
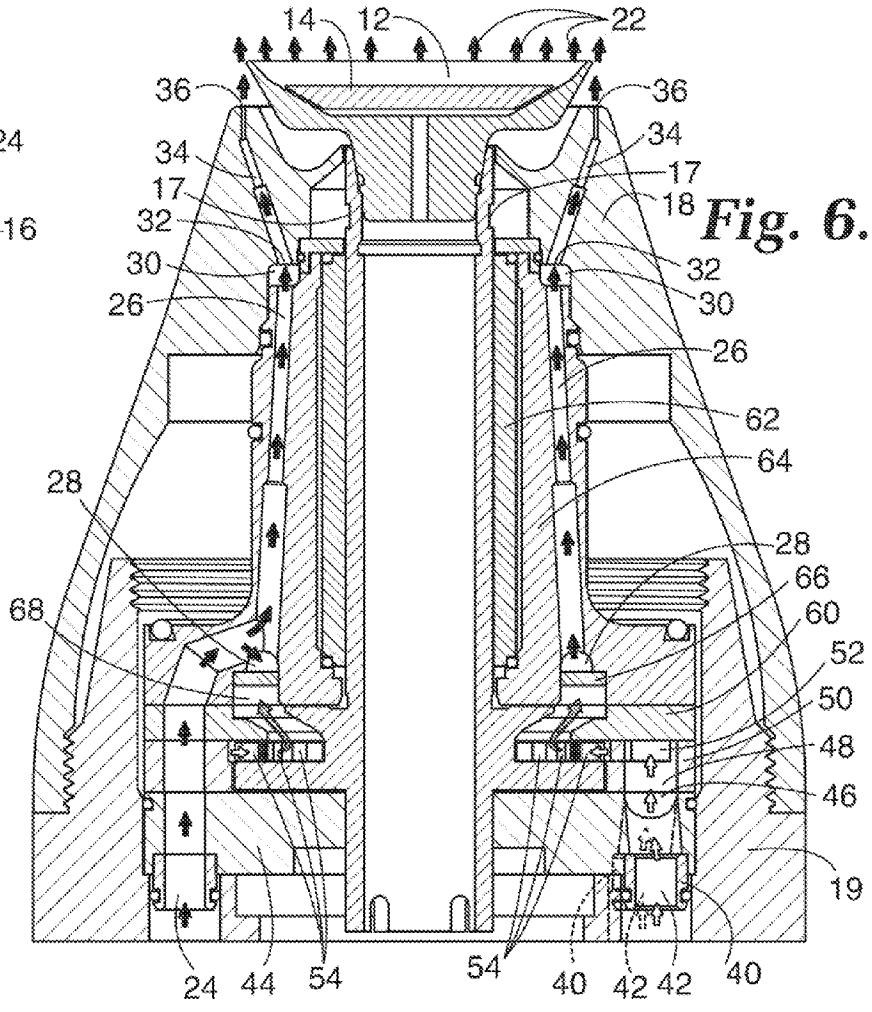
FIG. 6 is a cross-sectional view of elements according to the invention.

A sealing plate 66, shown in FIGS. 1 and 6 but not visible in FIG. 3, seals the plate assembly which is affixed to housing 64 as indicated. Also shown in housing 64 are the outlets 32 therefrom through which the shaping air passes and, for completeness, indents 17 formed in drive shaft 16 are shown, the purpose of such indents being to assist in assembly and disassembly of the apparatus.

Figure 4:
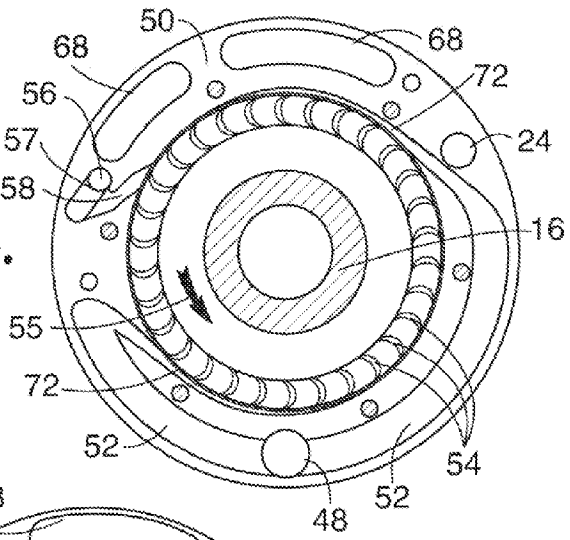
FIG. 4 is a top plan view of the intermediate drive and flow distribution plate of the invention shown housing the rotational turbine blade base and blades.

With concurrent reference to FIG. 3, FIG. 4 shows a top plan view of the intermediate flow distribution plate 50 showing the relative positioning of the elements previously described, specifically of single air inlet 48, air distribution channel 52 leading into two nozzles 72 which direct the air flowing therethrough to impinge onto turbine blades 54, as shown. Also illustrated is braking air inlet 56, braking air channel 58, exhaust air outlets 68, and, for completeness, the opening 24 for shaping air to pass therethrough. The turbine blades 54 affixed to drive shaft 16 are indicated to be driven rotatably by the indicated solid arrow 55 having both head and tail, which is also shown in FIG. 1.

Figure 5:
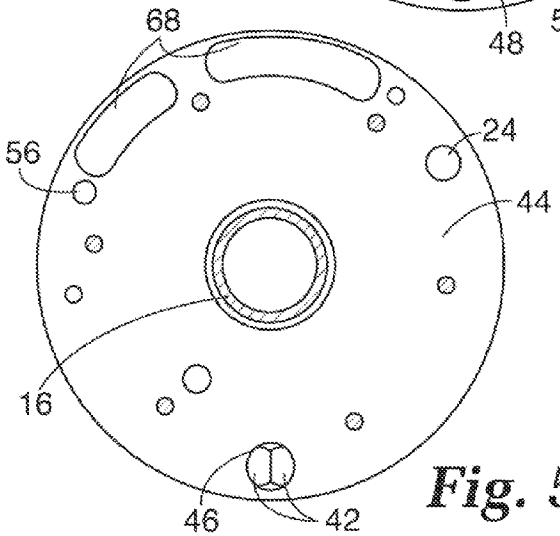
FIG. 5 is a top plan view of the connector plate according to the invention.

FIG. 5, to also be viewed with reference to FIG. 3, shows the connector plate 44 and the relative positions of elements therein, specifically its inlet channels 42, its single outlet 46, braking air supply 56, exhaust air outlets 68 and shaping air opening 24 therethrough. As previously described, referring to FIGS. 4 and 5, the cross-sectional area of the single inlet 48 into plate 44 is preferably equal to the total combined cross-sectional area of the two channels 42.

FIG. 6 shows, in cross-section, the embodiment of the invention depicted in FIG. 1 but here in full section and illustrating the flow of both the drive air (open arrows) and the shaping air (solid arrows) through the apparatus. With reference to FIG. 6, drive air enters inlet ports 40 in connector plate 44 and flows through converging channels 42 to single outlet 46 from which it exits and flows into single inlet 48 into the circumferential distribution channel 52 in intermediate distribution plate 50, and is diverted thereat and directed biaxially (FIG. 3) through channel 52 and thence through nozzles 72 (not visible) as described above to impinge upon the turbine blades 54 and drive the turbine before exiting the system through the annular opening (see FIG. 3) in the spacer plate 60 and the exhaust drive air returns 68 to the atmosphere.

Simultaneously, shaping air (solid arrows) enters inlet channel 24 from a source thereat (not shown) and is directed through the above-described openings in the connector plate 44, the intermediate plate 50, the spacer plate 60 and to the junction depicted at the confluence of inlet channel 24 with circumferential proximal manifold channel 28 and one of the axially oriented shaping air conduits 26. From that entry location, the shaping air is directed circumferentially about the turbine through proximal channel 28, thereby feeding all of the plurality of axially oriented conduits 26, and axially through the several conduits 26, as indicated. The plurality of axial conduits all discharge into distal manifold channel 30 extending circumferentially about the turbine and fluidly connecting all conduits 26, and the shaping air then exits the distal manifold channel 30 through outlets 32 and flows into exit air conduits 34 from which the shaping air passes through the exit air openings 36 and are directed to the outside surface of the bell cup 12 to form the circumferential cylindrical curtain of air extending around the cup 12, represented schematically by arrows 22, which controls and shapes the pattern of the coating material being applied to a workpiece (not shown).

As is evident in FIG. 6, the shaping air channels all are formed within the housing 64 of the turbine assembly and do not exit and/or return from/to the housing 64 during passage through the turbine. Neither do the shaping air channels pass through any openings or the like in the turbine bearing. The positioning of the shaping air channels as shown within the confines of the turbine housing envelope has the advantages that can result from less turbulence and fewer flow distortions occasioned by air flow through connections between different sections/parts of the apparatus.

As depicted in FIG. 6, the axially oriented shaping air conduits 26 are angled to the centerline of the apparatus. This angle is generally small in practice, and has the added advantage of making space available within the limitations of the spatial envelope defined by the outer boundary of the shroud 18 of the apparatus depicted in FIG. 6. That added space is specifically mentioned in the prior '750 patent, said to advantageously not reduce the construction space available for the turbine and accessories by the shaping air line (col. 4, ll. 26-31). This is a clear added advantage of the invention herein.

As indicated previously, the number of axially oriented shaping air conduits can range from 6-18, more or less, depending on space availability, and 12 conduits are illustrated, which is a preferred number for particular coating processes. Similarly, the number of exit air conduits can range from 8-30, more or less, the number being selectable by the skilled artisan. The 24 shown herein are also preferred for certain coating operations and for illustration of the basic concepts according to the invention.

As a practical note, the exit air conduits designated "34" in the drawings are each illustrated as comprising three stepped segments through the shroud 18. This construction is more amenable to machining of the exit air passageways, wherein the illustrated segments can be bored by drilling partly from the inside and partly from the outside of the shroud 18. The segmented representation of conduits 34 is not otherwise significant.

Figure 7:
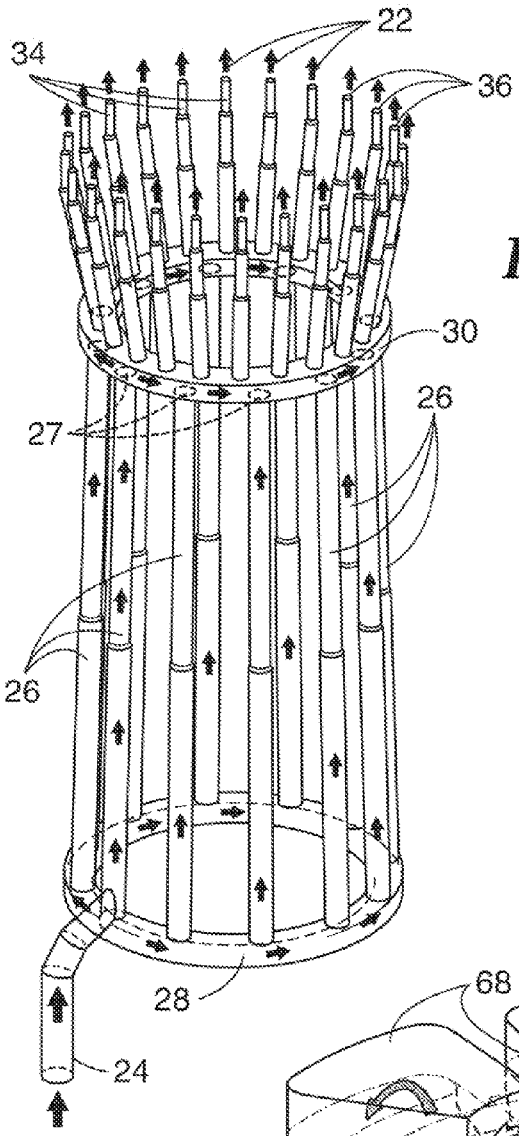
FIG. 7 is a schematic diagram of the shaping air flow paths within the apparatus of the invention.

FIG. 7 presents a schematic diagram of the elements through which the shaping air flows according to the invention and wherein all other elements have been removed, for simplified illustration purposes. Therein, shaping air (black arrows) enters shaping air inlet channel 24 and passes, as shown, into and through proximal manifold channel 28 extending coaxially and circumferentially around the turbine at its proximal end. The plurality of generally axially oriented shaping air conduits 26, shown here as 12 in number, are connected to and fluidly open to proximal manifold channel 28 at their proximal ends, and the shaping air flows through conduits 26 to outlets 27 opening into and connected thereat to the distal manifold channel 30, through which the air flows circumferentially therearound. Fluidly connected to distal manifold channel 30 are a plurality of exit air conduits 34, as shown, which convey the shaping air flowing from conduits 26 into channel 30 and through the outlets 32 (not seen; see FIG. 1) from manifold channel 30, through conduits 34, and to and through exit openings 36, which produce the curtain of air schematically represented by the arrows 22.

Figure 8:
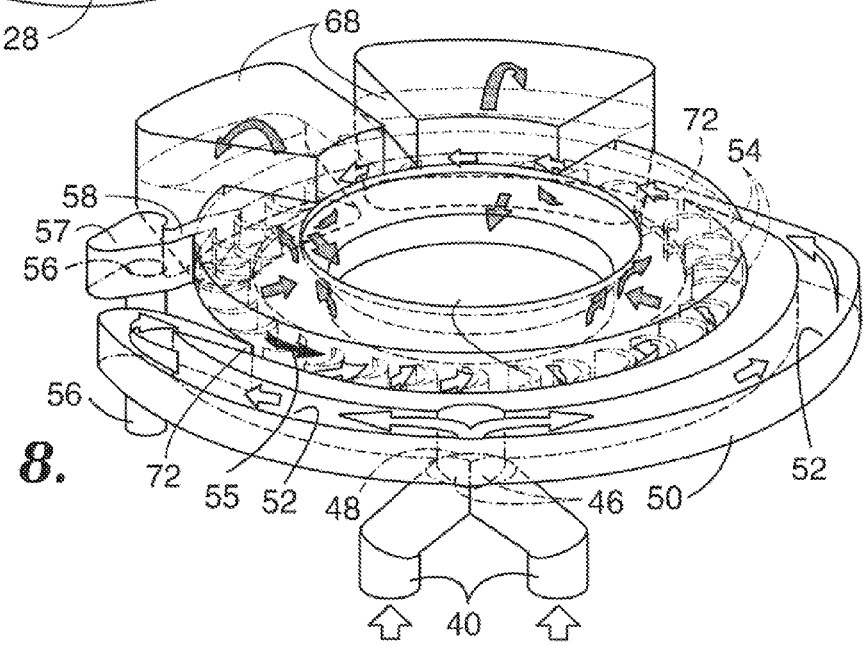
FIG. 8 is a schematic diagram of the drive air flow paths within the apparatus according to the invention.

FIG. 8, like FIG. 7, is a schematic diagram to illustrate the path of the drive air passing to and actuating the coating apparatus 10 according to the invention. Therein, drive air enters through conduits 40 into plate 50 and is distributed bi-directionally in circumferential distribution channel 52, flowing around channel 52 and into and through the two nozzles 72, air from which impinges on the turbine blades 54, which drives the system in the direction illustrated by the black tailed arrow. Spent air exhausting from the driven turbine blades 54, as illustrated by the shaded arrows, exits the system via exhaust air returns 68. For completeness, the valved brake air supply 56 feeding braking air into brake air inlet 57 and through braking air channel 58 in a direction opposite to the tailed arrow illustrated is shown.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. In rotary coating apparatus for coating a substrate comprising:

a rotatable bell cup coating applicator affixed to the distal end of a rotatable drive shaft driven by a turbine having a turbine housing, the turbine and turbine housing being contained within an external shroud, the apparatus including a source of supply of coating material, a source of pressurized air for driving said turbine, a second source of pressurized air for creating and directing a curtain of air circumferentially and externally about said bell cup to shape and control the diameter and pattern of applied coating material, said apparatus including:

multiple air passageways formed within and therethrough to convey said shaping air from said second source of air to and through said apparatus, wherein said passageways include an inlet channel leading into said turbine housing to initially convey said shaping air from said second source of pressurized air thereof to a manifold channel at the proximal end of said turbine housing extending coaxially and circumferentially within said turbine housing about the axis of rotation of said turbine, said proximal manifold channel having fluidly connected thereto a plurality of generally axially oriented shaping air conduits spaced apart circumferentially about the axis of rotation of said turbine and extending axially and substantially through said turbine housing, the proximal ends of said axially oriented shaping air conduits all opening into and being interconnected by said proximal manifold channel, and, wherein the distal ends of said axially oriented shaping air conduits are all interconnected by and open into a second manifold channel proximate the distal end of said turbine housing extending coaxially and circumferentially within said turbine housing about the axis of rotation of said turbine, and wherein said second, distal manifold channel has a plurality of outlets therefrom and therearound opening into and connected to a corresponding plurality of exit air conduits extending through said external shroud from said plurality of second manifold outlets, respectively, to exit openings from said shroud to the atmosphere positioned circumferentially adjacent the outside surface of said bell cup, to and through which said exit air conduits and openings said shaping air is conveyed, wherein, upon introduction of said shaping air into said apparatus, the shaping air is conveyed into and through the apparatus and exits through said exit openings around the periphery of said bell cup, thereby forming said shape-controlling curtain of air therearound.

2. The rotary coating apparatus of claim 1 including at least two external conduits for conveying said pressurized turbine driving air from said source thereof to said turbine, wherein said two external conduits are connected, respectively, to inlet ports in a connector plate affixed to said turbine, said connector plate having two channels therethrough, one channel extending from each said inlet port and thence converging with the second said channel and opening into a single drive air outlet from said connector plate, said single connector plate outlet mating at the base of said turbine with a single drive air inlet into a flow distribution intermediate plate of said turbine, which intermediate plate houses the blades of said turbine, said intermediate plate having a channel therein and therearound extending from said single drive air inlet partially and substantially in a direction circumferentially around said intermediate plate, and through which intermediate plate channel said drive air is directed bi-directionally to said turbine blades.

3. The apparatus of claim 2 wherein said flow distribution intermediate plate includes a valved inlet to and a braking channel having a nozzle formed therein disposed to channel drive air on command against said turbine blades in a direction opposite to the drive air direction of flow during a coating operation, to thereby provide a braking action to said turbine blades on command.

4. The apparatus of claim 2 wherein a plurality of nozzles extend from said channel in said intermediate plate, said nozzles having exit openings adjacent said turbine blades, all of which nozzles are formed within said intermediate plate to direct drive air onto said turbine blades in a common rotational direction.

5. The apparatus of claim 4 including two nozzles.

6. The apparatus of claim 5 wherein both said drive air outlet from said connector plate and said mating single drive air inlet to said flow distribution intermediate plate have cross-sectional areas which are twice the cross-sectional area of said two channels of said connector plate.

7. The apparatus of claim 1 wherein said coating material is paint and said bell cup applicator is a rotary bell cup atomizer.

8. The apparatus of claim 1 wherein said coating material is a powder coating material and said bell cup applicator is a rotary bell cup powder applicator.

9. The apparatus of claim 1 wherein said axially oriented shaping air conduits extend through said turbine housing parallel to the axis of rotation of the turbine.

10. The apparatus of claim 9 wherein said axially oriented shaping air conduits extend through said turbine housing at an angle to the axis of rotation of the turbine.

11. The apparatus of claim 1 including 6-18 said axially oriented shaping air conduits.

12. The apparatus of claim 11 including 12 said axially oriented shaping air conduits.

13. The apparatus of claim 1 including 8-30 said exit air conduits.

14. The apparatus of claim 13 including 24 exit air conduits.

15. A process of coating a substrate using the apparatus of claim 1.

16. A process of coating a substrate using the apparatus of claim 1 and including conveying, through at least two external conduits, said pressurized turbine driving air from said source thereof to said turbine, wherein said two external drive air conduits are connected, respectively, to inlet ports in a connector plate affixed to the base of said turbine, said connector plate having two channels therethrough, one channel extending from each said inlet port and thence converging with the second said channel and opening into a single drive air outlet from said connector plate, said single connector plate outlet mating at the base of said turbine with a single drive air inlet into a flow distribution intermediate plate of said turbine, which intermediate plate houses the blades of said turbine, said intermediate plate having a channel therein and therearound extending from said single drive air inlet partially and substantially in a direction circumferentially around said intermediate plate, and diverting said drive air through said intermediate plate channel into a plurality of nozzles extending from said channel to exit openings adjacent said turbine blades onto said turbine blades, thereby driving said turbine.

* * * * *